US007618130B2

(12) United States Patent
Yazaki

(10) Patent No.: US 7,618,130 B2
(45) Date of Patent: Nov. 17, 2009

(54) LIQUID JET HEAD AND LIQUID JET APPARATUS

(75) Inventor: Shiro Yazaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 540 days.

(21) Appl. No.: 10/545,069

(22) PCT Filed: Apr. 30, 2004

(86) PCT No.: PCT/JP2004/006332

§ 371 (c)(1),
(2), (4) Date: Aug. 9, 2005

(87) PCT Pub. No.: WO2004/098894

PCT Pub. Date: Nov. 18, 2004

(65) Prior Publication Data

US 2006/0098058 A1 May 11, 2006

(30) Foreign Application Priority Data

| | | |
|---|---|---|
| May 6, 2003 | (JP) | 2003-128258 |
| Oct. 17, 2003 | (JP) | 2003-358331 |
| Mar. 16, 2004 | (JP) | 2004-074396 |

(51) Int. Cl.
*B41J 2/045* (2006.01)

(52) U.S. Cl. ..... 347/71

(58) Field of Classification Search ..... 347/68–72
See application file for complete search history.

(56) References Cited

U.S. PATENT DOCUMENTS

| | | | | |
|---|---|---|---|---|
| 5,896,149 | A * | 4/1999 | Kitahara et al. | 347/70 |
| 6,431,690 | B1 * | 8/2002 | Shinkai et al. | 347/68 |
| 2003/0025769 | A1 * | 2/2003 | Shingai et al. | 347/70 |

FOREIGN PATENT DOCUMENTS

| | | | |
|---|---|---|---|
| JP | 2-122679 | A | 5/1990 |
| JP | 9-262980 | A | 10/1997 |
| JP | 10-286950 | A | 10/1998 |
| JP | 11-238920 | A | 8/1999 |
| JP | 2000-296616 | A | 10/2000 |
| JP | 2002-67299 | A | 3/2002 |
| JP | 2002-67316 | A | 3/2002 |
| JP | 2002-086717 | A | 3/2002 |
| JP | 2003-159801 | | 6/2003 |

* cited by examiner

*Primary Examiner*—Stephen D Meier
*Assistant Examiner*—Geoffrey Mruk
(74) *Attorney, Agent, or Firm*—Sughrue Mion, PLLC

(57) ABSTRACT

Provided are a liquid jet head capable of preventing occurrence of crosstalk and obtaining a stable liquid ejecting property and a liquid jet apparatus. Partitions 11 at both sides in a width direction of a pressure generating chamber 12 are provided so as to extend to the vicinity of an end of a reservoir portion 32 at the pressure generating chamber 12 side. Liquid supply paths 14 and communicating paths 100 are provided by being divided for each of the pressure generating chambers 12 by the partitions 11 (wall portions 11*a*). Specifically, each of the liquid supply paths 14 communicates with the pressure generating chamber 12 and is formed to have a width smaller than that of the pressure generating chamber 12, and each of the communicating paths 100 allows the liquid supply path 14 and a communicating portion 13 to communicate with each other and is formed to have a width larger than that of the liquid supply path 14. Thus, occurrence of crosstalk can be prevented and a stable liquid ejecting property can be obtained.

27 Claims, 8 Drawing Sheets

LIQUID JET HEAD AND LIQUID JET APPARATUS

TECHNICAL FIELD

The present invention relates to a liquid jet head which ejects liquid droplets and a liquid jet apparatus. Particularly, the present invention relates to an ink-jet recording head which ejects ink droplets from nozzle orifices and an ink-jet recording apparatus.

BACKGROUND ART

A following ink-jet recording head has been put to practical use. Specifically, in the ink-jet recording head, a part of pressure generating chambers communicating with nozzle orifices for ejecting ink droplets is formed of a vibration plate, this vibration plate is deformed by piezoelectric elements, ink in the pressure generating chambers is pressurized and thus the ink droplets are ejected from the nozzle orifices. For example, as the ink-jet recording head described above, there is one in which a uniform piezoelectric material layer is formed over an entire surface of the vibration plate by use of a deposition technology, this piezoelectric material layer is cut into a shape corresponding to pressure generating chambers by use of a lithography method and piezoelectric elements are formed so as to be independent for each of the pressure generating chambers. There is a problem that such piezoelectric elements are prone to be damaged due to external environments such as moisture (humidity). For example, in a reservoir that is a common liquid chamber of the pressure generating chambers, ink containing moisture is filled. Thus, it is required to secure a certain distance between the reservoir and the piezoelectric elements.

Here, as a structure for preventing such damage to the piezoelectric elements, Japanese Patent Laid-Open No. 2000-296616, for example, discloses a structure in which a reservoir forming plate having a piezoelectric element holding portion is joined with a passage-forming substrate having pressure generating chambers formed therein, and piezoelectric elements are sealed in this piezoelectric element holding portion. Specifically, the structure includes: a passage-forming substrate in which a plurality of pressure generating chambers communicating with nozzle orifices are provided; piezoelectric elements which cause pressure changes in the respective pressure generating chambers; a reservoir forming plate in which a reservoir portion constituting at least a part of a reservoir, that is a common liquid chamber of the pressure generating chambers, is provided; and a nozzle plate which is joined with an opposite surface side of the passage-forming substrate and has nozzle orifices. In addition, in a region of the reservoir forming plate which faces the piezoelectric elements, a piezoelectric element holding portion is provided, which, in a state of securing a space without inhibiting movement of the piezoelectric elements, can seal the space. Note that, at one end of the respective pressure generating chambers in a longitudinal direction, ink supply paths for supplying ink in the reservoir to the respective pressure generating chambers are provided.

However, even in the above-described head structure in which the piezoelectric elements are formed in the piezoelectric element holding portion, the piezoelectric elements are likely to be damaged by moisture contained in the ink in the reservoir if the moisture permeates a junction portion between the passage-forming substrate and the reservoir forming plate and enters into the piezoelectric element holding portion. Therefore, in either case, it is required to secure a sufficient distance between the piezoelectric elements and the reservoir portion, more specifically, a sufficient length of a junction portion between the piezoelectric element holding portion and the reservoir. Meanwhile, in order to improve an ink supply property, it is required to shorten a length of the ink supply path. Thus if sufficiently securing the junction portion between the piezoelectric element holding portion and the reservoir is attempted, a space formed of only the passage-forming substrate is formed along an arrangement direction of the pressure generating chambers between the ink supply paths and the reservoir.

In the ink-jet recording head having the structure as described above, in: ejection of the ink, because of pressure changes caused in the pressure generating chambers, the ink in the pressure generating chambers flows out toward the reservoir through the ink supply paths simultaneously with the ink ejection. Thus, if there exists the space formed of only the passage-forming substrate between the respective ink supply paths and the reservoir, the ink flowing out toward the reservoir from the respective pressure generating chambers flows in both directions within the space, including the arrangement direction of the pressure generating chambers (a nozzle arrangement direction) and the longitudinal direction of the pressure generating chambers (a direction orthogonal to the nozzle arrangement direction). Thus, there is a problem that flows of the ink flowing out from adjacent pressure generating chambers interfere with each other to cause a so-called crosstalk and a stable ink ejecting property cannot be obtained.

Note that, if the junction portion between the piezoelectric element holding portion and the reservoir is shortened in accordance with the length of the ink supply path, a junction area between the passage-forming substrate and the reservoir forming plate is reduced. Thus, sufficient junction strength cannot be obtained. Moreover, if the ink supply path is formed to be relatively long in order to secure the junction portion between the piezoelectric element holding portion and the reservoir, a cross-section area of the ink supply path is substantially increased. Thus, there arises a problem that a damping property of meniscus is lowered and high-speed drive becomes impossible to perform.

Note that, needless to say, such problems as described above similarly exist not only in the ink-jet recording head for ejecting ink but also in another liquid jet head for ejecting a liquid other than ink.

DISCLOSURE OF THE INVENTION

In consideration for the circumstances as described above, the object of the present invention is to provide a liquid jet head capable of preventing occurrence of crosstalk and obtaining a stable liquid ejecting property and a liquid jet apparatus.

A first aspect of the present invention for solving the foregoing object is a liquid jet head which includes: a passage-forming substrate in which a plurality of pressure generating chambers communicating with nozzle orifices are arranged; piezoelectric elements which are provided on the passage-forming substrate with a vibration plate interposed therebetween and each of which includes a lower electrode, a piezoelectric layer and an upper electrode; and a reservoir forming plate which is joined with a surface of the passage-forming substrate at the piezoelectric element side and has a reservoir portion provided therein, the reservoir portion constituting a part of a reservoir that is a common liquid chamber of the respective pressure generating chambers. In the liquid jet head, the reservoir is formed of the reservoir portion and a communicating portion provided in the passage-forming substrate. In addition, partitions at both sides in a width direction of the pressure generating chambers are provided so as to extend to the vicinity of an end of the reservoir portion at the pressure generating chamber side. Thus, liquid supply paths and communicating paths are provided while being separated for each of the pressure generating chambers by the partitions. Specifically, each of the liquid supply paths communicates with each of the pressure generating chambers and has a width smaller than that of the pressure generating chamber. Moreover, each of the communicating paths allows the liquid supply path and the communicating portion to communicate with each other and has a width larger than that of the liquid supply path.

In the first aspect, since the communicating paths are provided between the respective liquid supply paths and the reservoir, respectively, occurrence of crosstalk is prevented and a stable liquid ejecting property is obtained.

A second aspect of the present invention is the liquid jet head according to the first aspect, characterized in that a relationship between the width $w_1$ of the communicating path and the width $w_2$ of the pressure generating chamber satisfies $w_1 \geqq w_2$.

In the second aspect, a desired liquid supply property can be ensured.

A third aspect of the present invention is the liquid jet head according to one of the first and second aspects, characterized in that a relationship between the width $w_1$ of the communicating path and the width $w_3$ of the liquid supply path satisfies $w_1 \geqq 2 \times w_3$.

In the third aspect, since the communicating path is formed to have a predetermined size, a desired liquid supply property can be ensured.

A fourth aspect of the present invention is the liquid jet head according to any one of the first to third aspects, characterized in that a length of the communicating path is equal to or longer than a thickness of the passage-forming substrate.

In the fourth aspect, by providing the communicating path having a length which is equal to or longer than a predetermined length, occurrence of crosstalk is more effectively prevented.

A fifth aspect of the present invention is the liquid jet head according to any one of the first to fourth aspects, characterized in that a distance between an end of each of the partitions at the reservoir portion side and the reservoir portion is shorter than the thickness of the passage-forming substrate.

In the fifth aspect, since the end of the partition at the reservoir portion side is provided so as to extend to the vicinity of an end of the reservoir portion at the pressure generating chamber side, occurrence of crosstalks is prevented.

A sixth aspect of the present invention is the liquid jet head according to any one of the first to fifth aspects, characterized in that the piezoelectric elements are covered with an insulating film made of an inorganic insulating material.

In the sixth aspect, since the piezoelectric layer is covered with an insulating film made of an inorganic insulating material having a low moisture permeation rate, deterioration (destruction) of the piezoelectric layer (piezoelectric elements) due to moisture (humidity) is surely prevented over a long period of time.

A seventh aspect of the present invention is the liquid jet head according to the sixth aspect, characterized in that the insulating film is made of $Al_2O_3$.

In the seventh aspect, since the piezoelectric elements are covered with an insulating film made of a metallic oxide having an extremely low moisture permeation rate, destruction of the piezoelectric layer due to external environments is surely prevented.

An eighth aspect of the present invention is the liquid jet head according to any one of the first to seventh aspects, characterized in that, in the reservoir forming plate, a piezoelectric element holding portion capable of securing a space without inhibiting movement of the piezoelectric elements is provided in a region which faces the piezoelectric elements. Moreover, a region between the piezoelectric element holding portion and the reservoir portion in the reservoir forming plate is a junction portion between the reservoir forming plate and the passage-forming substrate.

In the eighth aspect, by providing the partitions so as to be extended to the vicinity of a boundary of the junction portion, between the passage-forming substrate and the reservoir forming plate, at the reservoir portion side, rigidity of the both members is ensured. Moreover, by providing the communicating paths, respectively, between the liquid supply paths and the communicating portion, occurrence of crosstalk is prevented.

A ninth aspect of the present invention is the liquid jet head according to the eighth aspect, characterized in that ends of the partitions at the reservoir portion side are positioned in a region which faces the junction portion.

In the ninth aspect, since the ends of the partitions protrude in the communicating portion, it is possible to surely prevent the partitions from obstructing formation of the reservoir.

A tenth aspect of the present invention is the liquid jet head according to one of the eighth and ninth aspects, characterized in that a length of the junction portion is equal to or longer than 200 μm.

In the tenth aspect, since the junction portion between the passage-forming substrate and the reservoir forming plate, the junction portion being positioned at the one end of the pressure generating chambers in the longitudinal direction, is formed to have a length which is equal to or longer than a predetermined length. Therefore, moisture contained in a liquid in the reservoir never actually permeates into the piezoelectric element holding portion. Thus, destruction of the piezoelectric elements is prevented. Moreover, the rigidity of the passage-forming substrate and the reservoir forming plate is enhanced.

An eleventh aspect of the present invention is the liquid jet head according to any one of the eighth to tenth aspects, further including an air release hole which has one end communicating with the piezoelectric element holding portion and the other end released to the atmosphere.

In the eleventh aspect, since the piezoelectric element holding portion is released to the atmosphere through the air release hole, no dew condensation occurs in the piezoelectric element holding portion. Thus, destruction of the piezoelectric elements due to the dew condensation is surely prevented.

A twelfth aspect of the present invention is the liquid jet head according to any one of the first to eleventh aspects, characterized in that the thickness of the passage-forming substrate is equal to or shorter than 100 μm.

In the twelfth aspect, the pressure generating chambers can be arranged relatively densely while maintaining rigidity of the partitions between the adjacent pressure generating chambers.

A thirteenth aspect of the present invention is the liquid jet head according to any one of the first to twelfth aspects, characterized in that the pressure generating chambers are formed by subjecting a single crystal silicon substrate to an anisotropic etching process.

In the thirteenth aspect, a liquid jet head having high-density nozzle orifices can be relatively easily manufactured.

A fourteenth aspect of the present invention is a liquid jet apparatus including the liquid jet head according to any one of the first to thirteenth aspects.

In the fourteenth aspect, it is possible to realize a liquid jet apparatus with a substantially stabilized liquid ejecting property and improved reliability.

BEST MODE FOR IMPLEMENTING THE PRESENT INVENTION

The present invention will be described in detail below based on embodiments.

Embodiment 1

Figure 1:
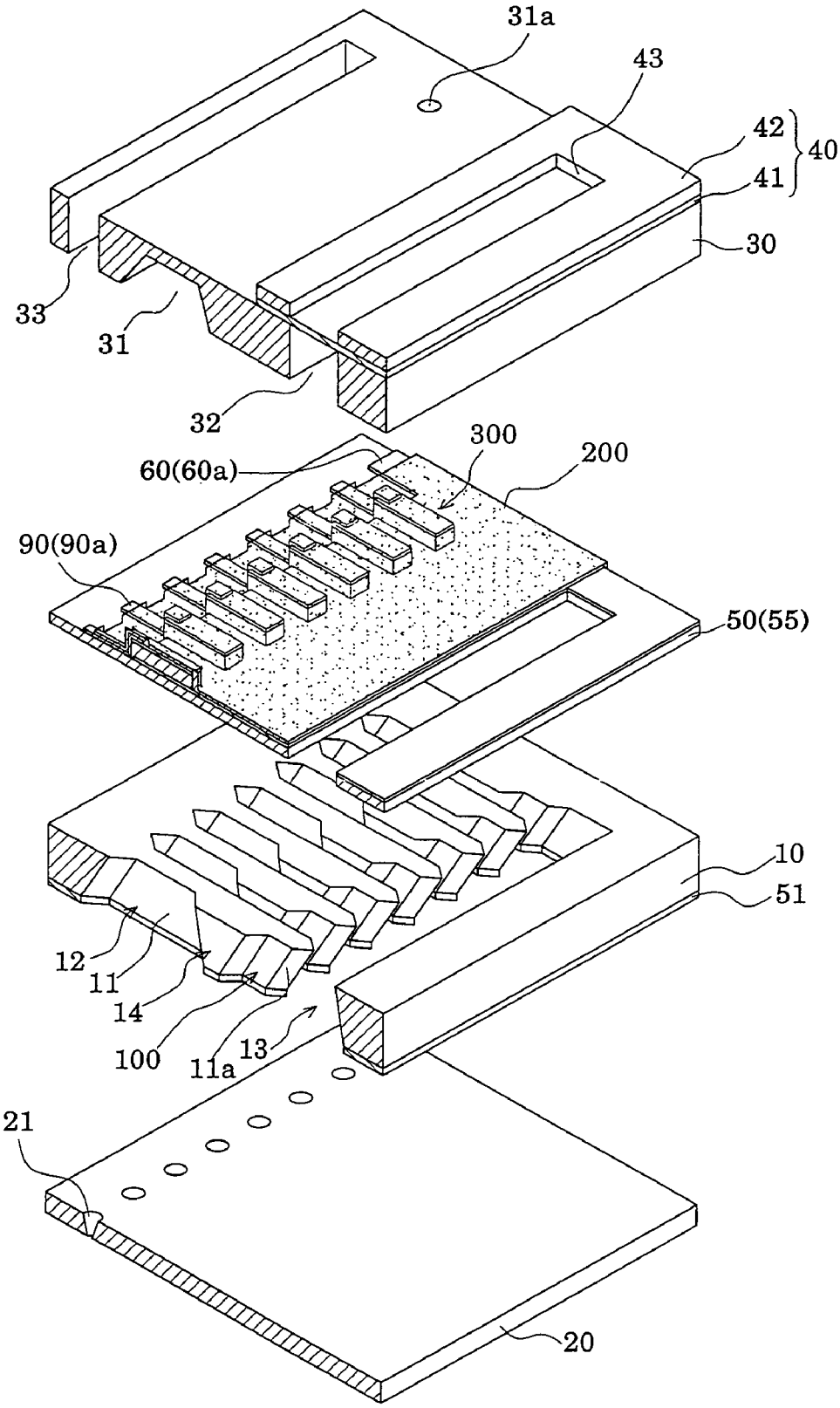
FIG. 1 is an exploded perspective view of a head according to embodiment 1.
Figure 2:
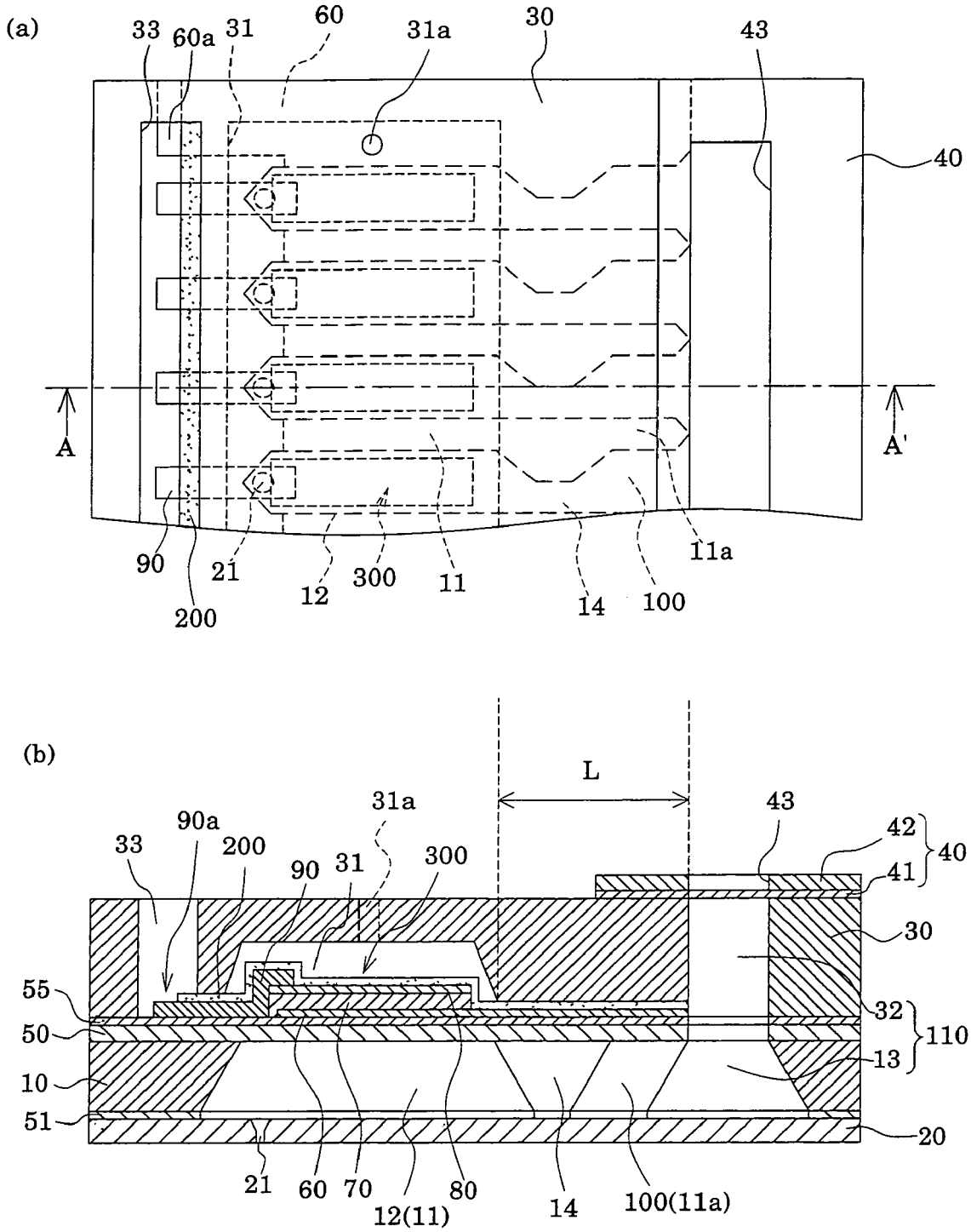
FIGS. 2(*a*) and 2(*b*) area plan view and a cross-sectional view of the head according to embodiment 1.

FIG. 1 is an exploded perspective view of an ink-jet recording head according to embodiment 1. FIG. 2(*a*) is a schematic plan view of FIG. 1 and FIG. 2(*b*) is a cross-sectional view along the line A-A' in FIG. 2(*a*). As shown in FIGS. 1 and 2, a passage-forming substrate 10 is made of a single crystal silicon substrate of plane orientation (110) in this embodiment. On both surfaces of the substrate, an elastic film 50, which is made of silicon dioxide previously formed by thermal oxidation, and a mask pattern 51, which is used as a mask in forming pressure generating chambers to be described later, are provided, respectively.

In the passage-forming substrate 10 described above, pressure generating chambers 12 are arranged in a width direction of the substrate, that is, arranged in parallel with a nozzle arrangement direction. Specifically, the pressure generating chambers 12 are formed by subjecting the substrate to an anisotropic etching process from its opposite surface side and are separated from each other by a plurality of partitions 11. Moreover, at one end of the pressure generating chambers 12 in a longitudinal direction (in a direction orthogonal to the nozzle arrangement direction), in addition to the pressure generating chambers 12, ink supply paths 14, communicating paths 100 and a communicating portion 13, which forms a part of a reservoir 110 to be a common ink chamber of the respective pressure generating chambers 12, are formed.

Each of the ink supply paths 14 communicates with the one end of the pressure generating chamber 12 in the longitudinal direction and has a smaller cross-section area than that of the pressure generating chamber 12. For example, in this embodiment, the ink supply path 14 is formed to have a smaller width than that of the pressure generating chamber 12 in such a manner that a passage at the pressure generating chamber 12 side between the reservoir 110 and the pressure generating chamber 12 is narrowed in a width direction of the pressure generating chamber. Note that, as described above, in this embodiment, the ink supply path 14 is formed by narrowing the width of the passage from one side. However, the ink supply path may be formed by narrowing the width of the passage from both sides. Moreover, each of the communicating paths 100 is formed in such a manner that the partitions 11 at both sides in the width direction of the pressure generating chamber 12 are provided so as to extend toward the communicating portion 13 and a space between the ink supply path 14 and the communicating portion 13 is separated. Note that the communicating path 100 will be described later in detail.

Here, anisotropic etching is performed by utilizing a difference in an etching rate of the single crystal silicon substrate. For example, in this embodiment, when the single crystal silicon substrate is dipped in an alkaline solution such as KOH, the substrate is gradually eroded and there appear a first (111) plane perpendicular to the (110) plane and a second (111) plane. The angle formed by the meeting of the second (111) plane and the first (111) plane is approximately 70 degrees, and the angle formed by the meeting of the second (111) plane and the foregoing (110) plane is approximately 35 degrees. Accordingly, an etching rate of the (111) planes is compared to that of the (110) plane. Thus, the anisotropic etching is performed by utilizing a characteristic that the etching rate of the (111) planes is about 1/180 of that of the (110) plane. By use of the anisotropic etching, high-precision processing can be performed by taking depth processing to form a parallelogram shape, which is formed by two of the first (111) planes and two of the oblique second (111) planes, as its basis. Therefore, the pressure generating chambers 12 can be arranged in the high density.

In this embodiment, long sides of each pressure generating chamber 12 are formed of the first (111) planes and short sides thereof are formed of the second (111) planes. This pressure generating chamber 12 is formed by performing etching up to the elastic film 50 while nearly penetrating the passage-forming substrate 10. Here, an extremely small part of the elastic film 50 is dipped in the alkaline solution used in etching the single crystal silicon substrate.

A thickness of the passage-forming substrate 10 as described above may be selected to be optimum in accordance with a density of arrangement of the pressure generating chambers 12. For example, in the case of disposing about 180 of the pressure generating chambers 12 per inch (180 dpi), the thickness of the passage-forming substrate 10 may be set to about 220 μm Moreover, in the case of disposing the pressure generating chambers 12 as relatively densely as, for example, 200 dpi or more, it is preferable that the passage-forming substrate 10 is formed to be as relatively thin as 100 μm or less, particularly 70 μm. This is because the density of arrangement of the pressure generating chambers 12 can be increased while maintaining rigidity of the partitions 11 between the adjacent pressure generating chambers 12.

Moreover, at the open face side of the passage-forming substrate 10, a nozzle plate 20 having nozzle orifices 21 drilled therein is joined. The nozzle plate 20 as described above is made of glass ceramics, a single crystal silicon substrate, stainless steel or the like with a thickness of, for example, 0.05 to 1 mm. The nozzle plate 20 entirely covers the one surface of the passage-forming substrate 10 with its one surface and also serves as a reinforcing plate which protects the passage-forming substrate 10 from impact and external force. Here, a size of the pressure generating chamber 12 for applying an ink droplet ejecting pressure to ink and a size of the nozzle orifice 21 for ejecting ink droplets are optimized in accordance with an amount of ink droplets to be ejected, an ejecting speed and an ejecting frequency. For example, in the case of recording 360 of ink droplets per inch, it is required to form the nozzle orifice 21 with a diameter of several ten μm with high precision.

Meanwhile, on the elastic film 50 having a thickness of, for example, about 1.0 μm at the opposite side to the open face of the passage-forming substrate 10, a lower electrode film 60 having a thickness of, for example, about 0.2 μm, a piezoelectric layer 70 having a thickness of, for example, about 1.0 μm and an upper electrode film 80 having a thickness of, for example, about 0.05 μm are laminated in a process to be described later. Those electrode films and piezoelectric layer are laminated on the elastic film 50 with an insulating film 55 with a thickness of, for example, 0.4 μm interposed therebetween and constitute a piezoelectric element 300. Here, the piezoelectric elements 300 mean a part including the lower electrode film 60, the piezoelectric layer 70 and the upper electrode film 80. In general, the piezoelectric elements 300 are formed by using any one of the electrodes thereof as a common electrode and patterning the other electrode and the piezoelectric layer 70 for each of the pressure generating chambers 12. Consequently, here, a part which includes any one of the electrodes patterned and the piezoelectric layer 70, and in which piezoelectric strain occurs due to voltage application to the both electrodes, is called a piezoelectric active portion. In this embodiment, the lower electrode film 60 is used as the common electrode of the piezoelectric elements 300 and the upper electrode film 80 is used as an individual electrode thereof. However, even if this order is reversed because of a drive circuit and wiring, there is no trouble caused thereby. In either case, the piezoelectric active portion is formed in each pressure generating chamber. Moreover, here, the piezoelectric elements 300 and the vibration plate displaced by drive of the piezoelectric elements 300 are collectively called a piezoelectric actuator. Note that, in the example described above, the elastic film 50, the insulating film 55 and the lower electrode film 60 function as the vibration plate.

As a material of the piezoelectric layer 70, for example, a relaxer ferroelectric substance or the like may be used, which is obtained by adding metal such as niobium, nickel, magnesium, bismuth and ytterbium to a ferroelectric piezoelectric material such as lead-zirconate-titanate (PZT). A composition thereof may be appropriately selected in consideration of characteristics of the piezoelectric element, use thereof and the like. For example, the following compositions are enumerated, including $PbTiO_3$(PT), $PbZrO_3$(PZ), $Pb(Zr_xTi_{1-x})O_3$(PZT), $Pb(Mg_{1/3}Nb_{2/3})O_3$—$PbTiO_3$(PMN—PT) $Pb(Zn_{1/3}Nb_{2/3})O_3$—$PbTiO_3$(PZN—PT), $Pb(Ni_{1/3}Nb_{2/3})O_3$—$PbTiO_3$(PNN—PT) $Pb(In_{1/2}Nb_{1/2})O_3$—$PbTiO_3$(PIN—PT), $Pb(Sc_{1/3}Ta_{1/2})O_3$—$PbTiO_3$(PST—PT) $Pb(Sc_{1/3}Nb_{1/2})O_3$—$PbTiO_3$(PSN—PT), $BiScO_3$—$PbTiO_3$(BS—PT), $BiYbO_3$—$PbTiO_3$(BY—PT) and the like.

Accordingly, with one end of each upper electrode film 80 that is the individual electrode of the piezoelectric elements 300 including the piezoelectric layer 70 as described above, a lead electrode 90 is connected. Specifically, the lead electrode 90 is made of, for example, gold (Au) or the like and has one end extended to a region corresponding to a through-hole 33 to be described later. Moreover, the piezoelectric elements 300 are covered with an insulating film 200 made of an inorganic insulating material. For example, in this embodiment, a pattern region including the respective layers constituting the piezoelectric elements 300 and the lead electrode 90 is covered with the insulating film 200 except a region facing connection portions 60*a* and 90*a* of the lower electrode film 60 and the lead electrode 90, which are connected through unillustrated drive IC and connection wirings. Specifically, surfaces (upper faces and end faces) of the lower electrode film 60, the piezoelectric layer 70, the upper electrode film 80 and the lead electrode 90 in the pattern region are covered with the insulating film 200.

Here, a material of the insulating film 200 as described above is not particularly limited as long as the material is an inorganic insulating material. Although aluminum oxide ($Al_2O_3$), tantalum pentoxide ($Ta_2O_5$), silicon dioxide ($SiO_2$) and the like, for example, are enumerated, it is preferable to use aluminum oxide ($Al_2O_3$) Particularly, in the case of using aluminum oxide, even if the insulating film 200 is formed to be as thin as about 100 nm, moisture permeation under a high-humidity environment can be sufficiently prevented. Note that, when an organic insulating material such as resin is used, for example, as the material of the insulating film, the moisture permeation cannot be sufficiently prevented with the same thickness as that of the insulating film made of the inorganic insulating material described above. Moreover, if the film thickness of the insulating film is increased in order to prevent the moisture permeation, there may arise a problem that movement of the piezoelectric elements is hindered.

The insulating film 200 made of the inorganic insulating material as described above has extremely low moisture permeability even if the film is thin. Thus, by covering the surfaces of the lower electrode film 60, the piezoelectric layer 70, the upper electrode film 80 and the lead electrode 90 with the insulating film 200 described above, destruction of the piezoelectric layer 70 due to moisture (humidity) can be prevented. Moreover, by covering the surfaces of the lead electrode 90 and the respective layers constituting the piezoelectric elements 300, except the connection portions 60*a* and 90*a*, even if moisture enters from a space between these layers and the insulating film 200, it is possible to prevent the moisture from reaching the piezoelectric layer 70. Accordingly, the destruction of the piezoelectric layer 70 due to moisture can be more surely prevented.

Moreover, on the passage-forming substrate 10 having the piezoelectric element 300 formed thereon, a reservoir forming plate 30 is joined. In this reservoir forming plate 30, a reservoir portion 32 constituting a part of the reservoir 110 is provided outside the respective pressure generating chambers 12 in the longitudinal direction. In this embodiment, the reservoir portion 32 is formed across the width direction of the pressure generating chambers 12 while penetrating the reservoir forming plate 30 in its thickness direction. In addition, the reservoir portion 32 is communicated with the communicating portion 13 of the passage-forming substrate 10 through a penetrating portion provided in the elastic film 50 and the insulating film 55 and forms the reservoir 110 to be a common ink chamber of the respective pressure generating chambers 12. Note that a thickness of the reservoir forming plate 30 as described above is, for example, 200 to 400 μm.

Moreover, in this embodiment, in the reservoir forming plate 30 as described above, a piezoelectric element holding portion 31 capable of securing a space without inhibiting movement of the piezoelectric elements 300 is provided in a region facing the piezoelectric elements 300. Specifically, the piezoelectric elements 300 are formed inside the piezoelectric element holding portion 31.

Furthermore, in this embodiment, an air release hole 31*a* which has one end communicating with the piezoelectric element holding portion 31 and the other end being released to the atmosphere is provided in the reservoir forming plate 30 described above. Specifically, the piezoelectric element holding portion 31 is released to the atmosphere through the air release hole 31*a* without sealing the piezoelectric elements 300 therein. Thus, occurrence of dew condensation in the piezoelectric element holding portion 31 can be prevented. Consequently, destruction of the piezoelectric elements 300 due to the dew condensation can be surely prevented. Note that the other end of the air release hole 31*a* as described above is released to the atmosphere in a region which does not interfere with, for example, wiring provided on the opposite surface to that of the piezoelectric element holding portion 31 of the reservoir forming plate 30, drive ICs mounted on the wiring and the like.

Figure 3:
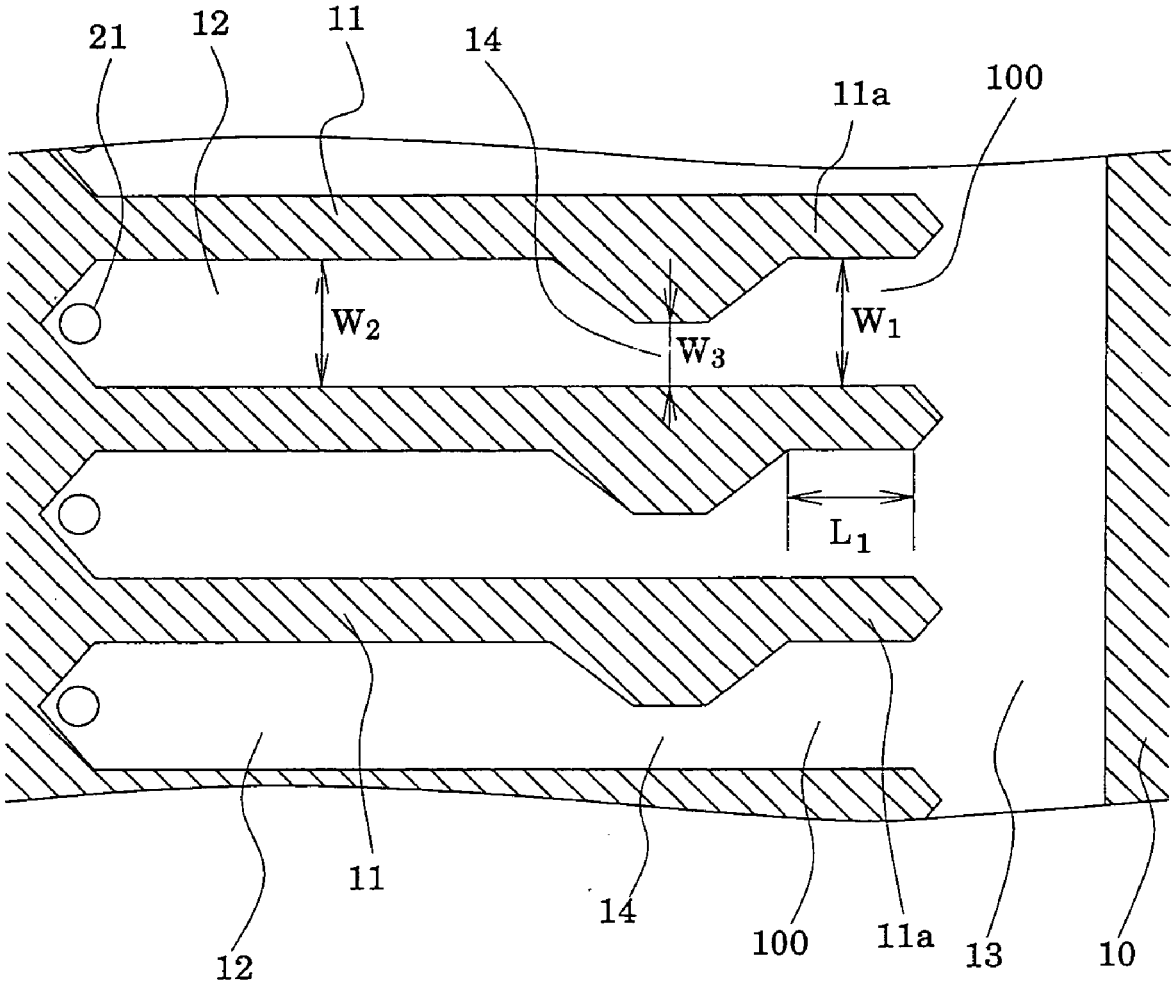
FIG. 3 is a cross-sectional view showing a passage structure of the head according to embodiment 1.

Moreover, the reservoir 110 of the reservoir forming plate 30 as described above and the respective pressure generating chambers 12 of the passage-forming substrate 10 are communicated with each other through the ink supply paths 14 and the communicating paths 100. Here, with reference to FIG. 3, the communicating path 100 will be described in detail. Note that FIG. 3 is a cross-sectional view showing a passage structure of the ink-j et recording head according to embodiment 1. As shown in FIG. 3, the communicating paths 100 are provided so as to be separate from each other for each of the pressure generating chambers 12 between the respective ink supply paths 14 and the communicating portion 13. Together with the ink supply paths 14, the communicating paths 100 form separate passages between the respective pressure generating chambers 12 and the reservoir 110.

To be more specific, the partitions 11 at the both sides in the width direction of the pressure generating chamber 12 are provided so as to extend to the vicinity of an end of the reservoir portion 32 at the pressure generating chamber 12 side. Specifically, in this embodiment, the partitions 11 at the both sides in the width direction of the pressure generating chamber 12 are provided so as to extend to the vicinity of an end of a junction portion between the passage-forming substrate 10 and the reservoir forming plate 30 at the reservoir portion 32 side. By extending the respective partitions 11 as described above, wall portions 11*a* are formed between the respective ink supply paths 14 and the communicating portion 13. Accordingly, a space between the ink supply paths 14 and the communicating portion 13 is divided by these wall portions 11*a* and the respective communicating paths 100 are formed.

Moreover, it is preferable that a width of the communicating path 100 is formed to be relatively wide. For example, it is preferable that a relationship between the width $w_1$ of the communicating path 100 and the width $w_2$ of the pressure generating chamber 12 satisfies $w_1 \geqq w_2$. Furthermore, it is preferable that a relationship between the width $w_1$ of the communicating path 100 and the width $w_3$ of the ink supply path 14 satisfies $w_1 \geqq 2 \times w_3$. As described above, by providing the communicating path 100 to have a predetermined size, a desired ink supply property can be obtained. Here, as ink, used is one having viscosity within a range of about 2.0 to 12.0 mPa·sec in an environment with a temperature within a range of about 10 to 40° C. To be more specific, as normal ink, one having viscosity within a range of about 2.0 to 6.5 mPa·sec is enumerated and, as high-viscosity pigmented ink, one having viscosity within a range of about 8 to 11 mPa·sec is enumerated.

As described above, in this embodiment, the communicating paths 100 are provided with the predetermined width so as to be separate from each other for each of the pressure generating chambers 12 by use of the wall portions 11*a* in a region facing the junction portion between the passage-forming substrate 10 and the reservoir forming plate 30, the region being positioned at the one end of the pressure generating chambers 12 in the longitudinal direction. Specifically, the communicating paths 100 are provided between the respective ink supply paths 14 and the reservoir 110. Thus, in ink ejection, ink flowing out toward the reservoir 110 from the adjacent ink supply paths 14 do not interfere with each other and occurrence of crosstalks can be prevented. Therefore, regardless of whether or not ink droplets are ejected from the adjacent nozzle orifices 21, a stable ink ejecting property can be obtained. Moreover, it is possible to shorten a length of the ink supply path without generating crosstalk. Therefore, it is also made possible to substantially enhance a damping property of meniscus and to realize high-speed drive of the head.

Moreover, in the present invention, it is preferable that, by providing the wall portion ha to have a predetermined length or more, the length $L_1$ of the communicating path 100 (see FIG. 3) is set to a predetermined length or more. Specifically, it is preferable that the length of the communicating path 100 is set to the thickness of the passage-forming substrate 10 or more. Note that the length $L_1$ of the communicating path 100 corresponds to a region where the width $w_1$ of the communicating path 100 is secured. Accordingly, in the ink ejection, the ink flowing out toward the reservoir 110 from the adjacent ink supply paths 14 flows out separately to the reservoir 110 along the communicating paths 100 and do not interfere with each other. Thus, the occurrence of crosstalk can be effectively prevented. For example, in this embodiment, the thickness of the passage-forming substrate 10 is set to about 70 μm and the length of the communicating path 100 is set to about 100 μm. Note that, by setting the length of the communicating path 100 to the thickness of the passage-forming substrate 10 or more as described above, although described later in detail, it is possible to secure a sufficient length L of the junction portion of the reservoir forming plate 30 and the passage-forming substrate 10 between the piezoelectric element holding portion 31 and the reservoir portion 32.

Here, it is preferable that the length L of the junction portion (see FIG. 2) of the passage-forming substrate 10 and the reservoir forming plate 30 between the piezoelectric element holding portion 31 and the reservoir 110 is 200 μm or more. Accordingly, a distance between the piezoelectric element holding portion 31 and the reservoir portion 32 can be secured. Thus, it is possible to prevent moisture contained in the ink in the reservoir 110 from entering the piezoelectric element holding portion 31 and to surely prevent destruction of the piezoelectric elements 300 due to the moisture. Moreover, since a junction area between the passage-forming substrate 10 and the reservoir forming plate 30 is increased, there is also an effect that rigidity of both members can be sufficiently ensured and durability of the head can be improved.

Note that it is preferable that the ends of the wall portions 11*a*, which form the communicating paths 100, at the reservoir portion 32 side are positioned in a region which faces the junction portion where the passage-forming substrate 10 and the reservoir forming plate 30 are joined. This is because, if the ends of the wall portions 11*a* protrude in the communicating portion 13, the ends thereof will obstruct formation of the reservoir 110 in a manufacturing process to be described later by penetrating the elastic film 50 and the insulating film 55, which separate the communicating portion 13 and the reservoir portion 32.

Figure 4:
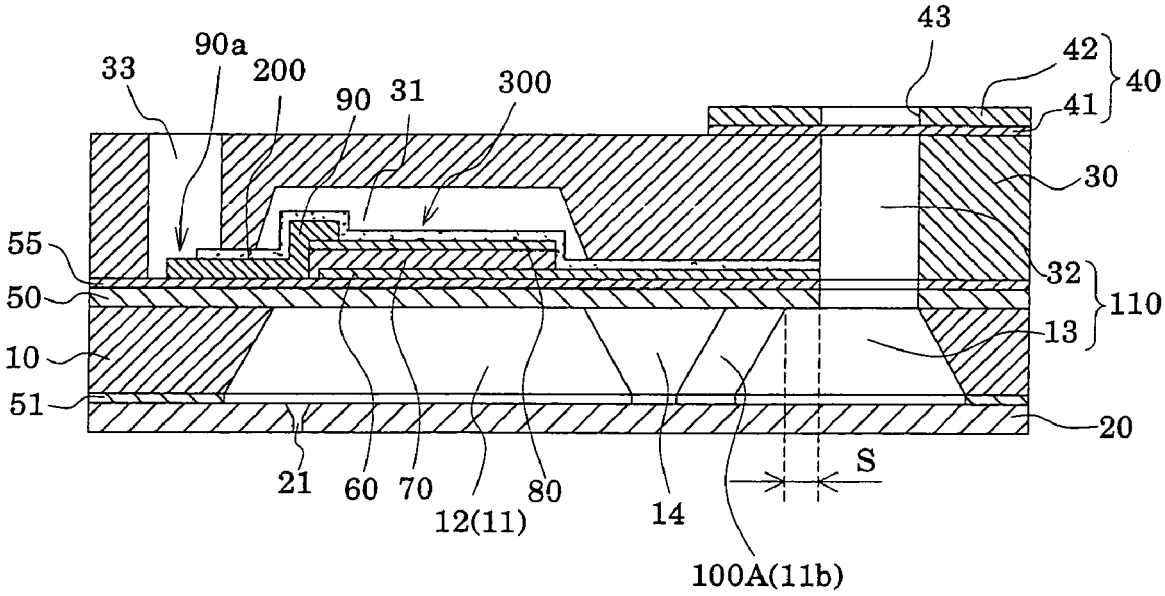
FIG. 4 is a cross-sectional view of another head according to embodiment 1.

Moreover, in the present invention, it is preferable that a distance between the end of the partition 11 (the wall portion 11*a*) at the reservoir portion 32 side and the reservoir portion 32 is set to be short. Specifically, as shown in FIG. 4, it is preferable that the distance S between the end of the partition 11 at the reservoir portion 32 side and the reservoir portion 32 is set to be shorter than the thickness of the passage-forming substrate 10. Thus, the partition 11 is provided so as to extend to the vicinity of the end of the reservoir portion 32 at the pressure generating chamber 12 side. Accordingly, a space between the ink supply path 14 and the communicating portion 13 (the reservoir 110), to be more specific, a space which is formed of only the passage-forming substrate 10 and which extends in the width direction of the pressure generating chamber 12 can be divided by the wall portion 11*a* and be reduced. Consequently, interference between ink flowing out from adjacent communicating paths 100A can be reduced and the occurrence of crosstalk can be prevented.

Moreover, in a region opposite to the reservoir portion 32 of the reservoir forming plate 30, the through-hole 33 which penetrates the reservoir forming plate 30 in its thickness direction is provided. The lead electrode 90 extracted from each piezoelectric element 300 has its end and the vicinity thereof exposed in the through-hole 33. As the reservoir forming plate 30 described above, a material having approximately the same coefficient of thermal expansion as that of the passage-forming substrate 10, such as, for example, glass, a ceramics material or the like is preferably used. In this embodiment, the reservoir forming plate 30 is formed by use of a single crystal silicon substrate, which is the same material as that of the passage-forming substrate 10.

Note that, in a region corresponding to the reservoir portion 32 of the reservoir forming plate 30, a compliance plate 40 including a sealing film 41 and a fixed plate 42 is joined. Here, the sealing film 41 is made of a material having low rigidity and flexibility (for example, a polyphenylene sulfide (PPS) film with a thickness of 6 μm) and this sealing film 41 seals one surface of the reservoir portion 32. Moreover, the fixed plate 42 is formed by use of a hard material such as metal (for example, stainless-steel (SUS) with a thickness of 30 μm or the like). A region of this fixed plate 42, the region corresponding to the reservoir 110, is an opening portion 43 which is obtained by entirely removing the fixed plate 42 in the region in its thickness direction. Thus, the one surface of the reservoir 110 is sealed by use of only the sealing film 41 having flexibility.

The ink-jet recording head of this embodiment described above takes in ink from unillustrated ink supply means and fills the inside thereof from the reservoir 110 to the nozzle orifices 21 with the ink. Thereafter, in accordance with a driving signal from an unillustrated drive IC, the head applies drive voltages between the respective lower electrode film 60 and upper electrode film 80 which correspond to the respective pressure generating chambers 12. Accordingly, the elastic film 50, the insulating film 55 and the piezoelectric element 300 are displaced. Thus, the pressure in the respective pressure generating chambers 12 are increased and ink droplets are ejected from the nozzle orifices 21.

TEST EXAMPLE

Figure 5:
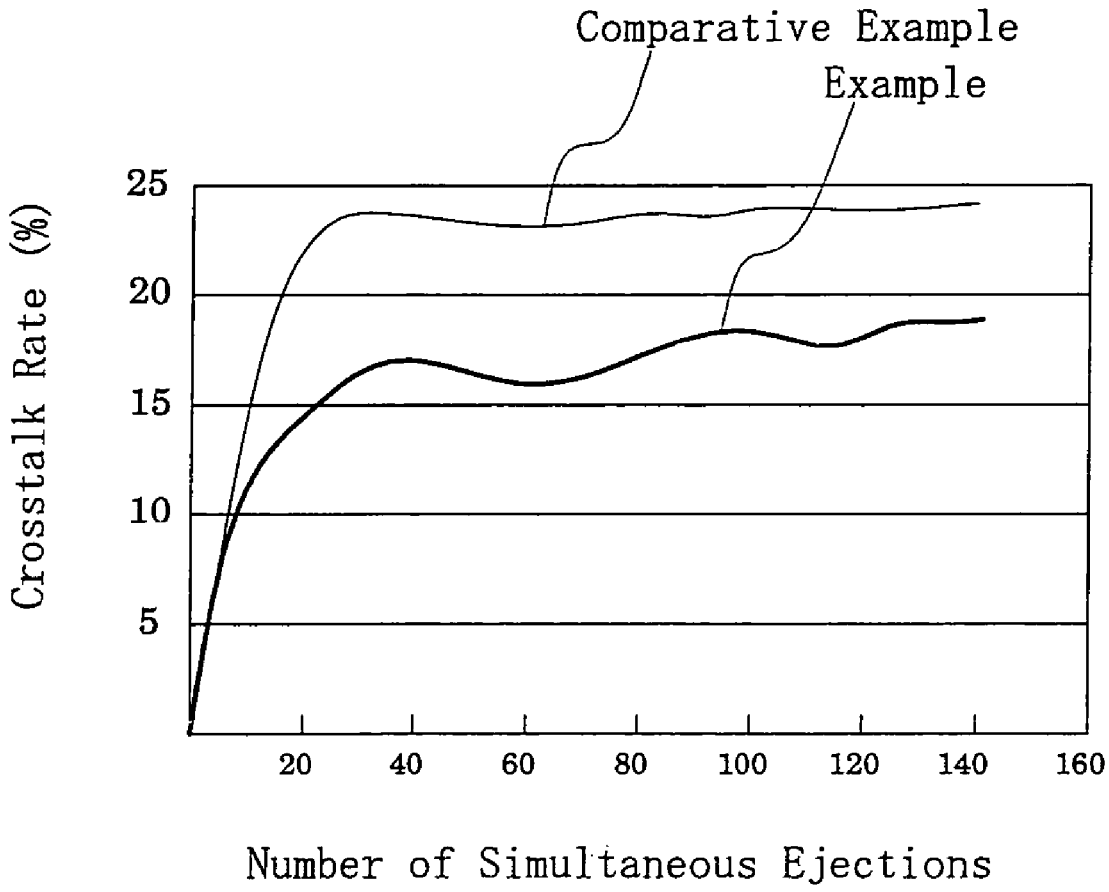
FIG. 5 is a graph showing a relationship between the number of simultaneous ejections and a crosstalk rate.

Here, a head having communicating paths provided therein (example) and a head in which no communicating paths were provided and a space formed of only a passage-forming substrate was provided across an arrangement direction of respective pressure generating chambers between ink supply paths and a reservoir (comparative example) were prepared. Accordingly, a test for comparing crosstalk rates (%) of the both heads was carried out. To be more specific, one nozzle to be a reference (reference nozzle) was determined, an ejecting speed when ink was ejected only from the reference nozzle was set as a reference value "0" and an ejecting speed of ink droplets to be ejected from the reference nozzle when the ink was ejected from the reference nozzle and nozzles at both sides thereof at the same time was measured. Thereafter, while increasing the number of nozzles, from which the ink was simultaneously ejected, by 2, transition (rate of change) of the ejecting speed in the reference nozzle was examined. FIG. 5 shows a result thereof. Note that, in FIG. 5, the rate of change of the ejecting speed in the reference nozzle is shown as the crosstalk rate (%).

As shown in FIG. 5, as to the head of the comparative example, when the number of simultaneous ejections reaches about 20, an increasing rate of the ejecting speed in the reference nozzle, that is, the crosstalk rate is increased to about 20% and is eventually increased close to 25%. On the other hand, as to the head of the example, when the number of simultaneous ejections reaches about 20, although the crosstalk rate is increased to about 15% with the same transition as that of the comparative example, the rate subsequently remains stable within a range below 20%. As is clear from the result described above, it is found that the crosstalk rate in the head of the example is relatively about 10% lower than that in the head of the comparative example. Therefore, as in the case of the head of the example, occurrence of crosstalk in ink ejection can be reduced by providing the communicating paths.

Figure 6:
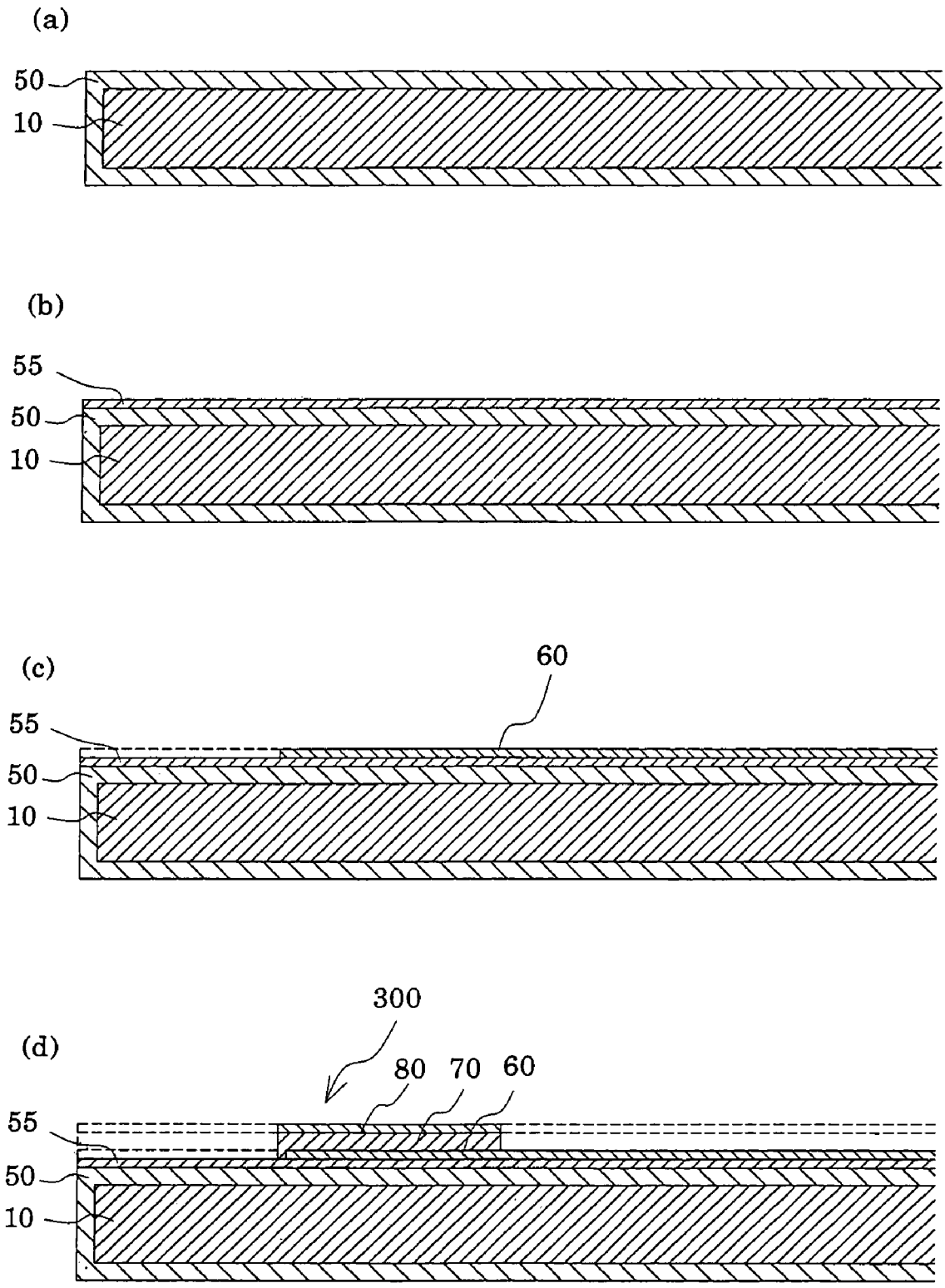
FIGS. 6(*a*) to 6(*d*) are cross-sectional views showing steps of manufacturing the head according to embodiment 1.
Figure 7:
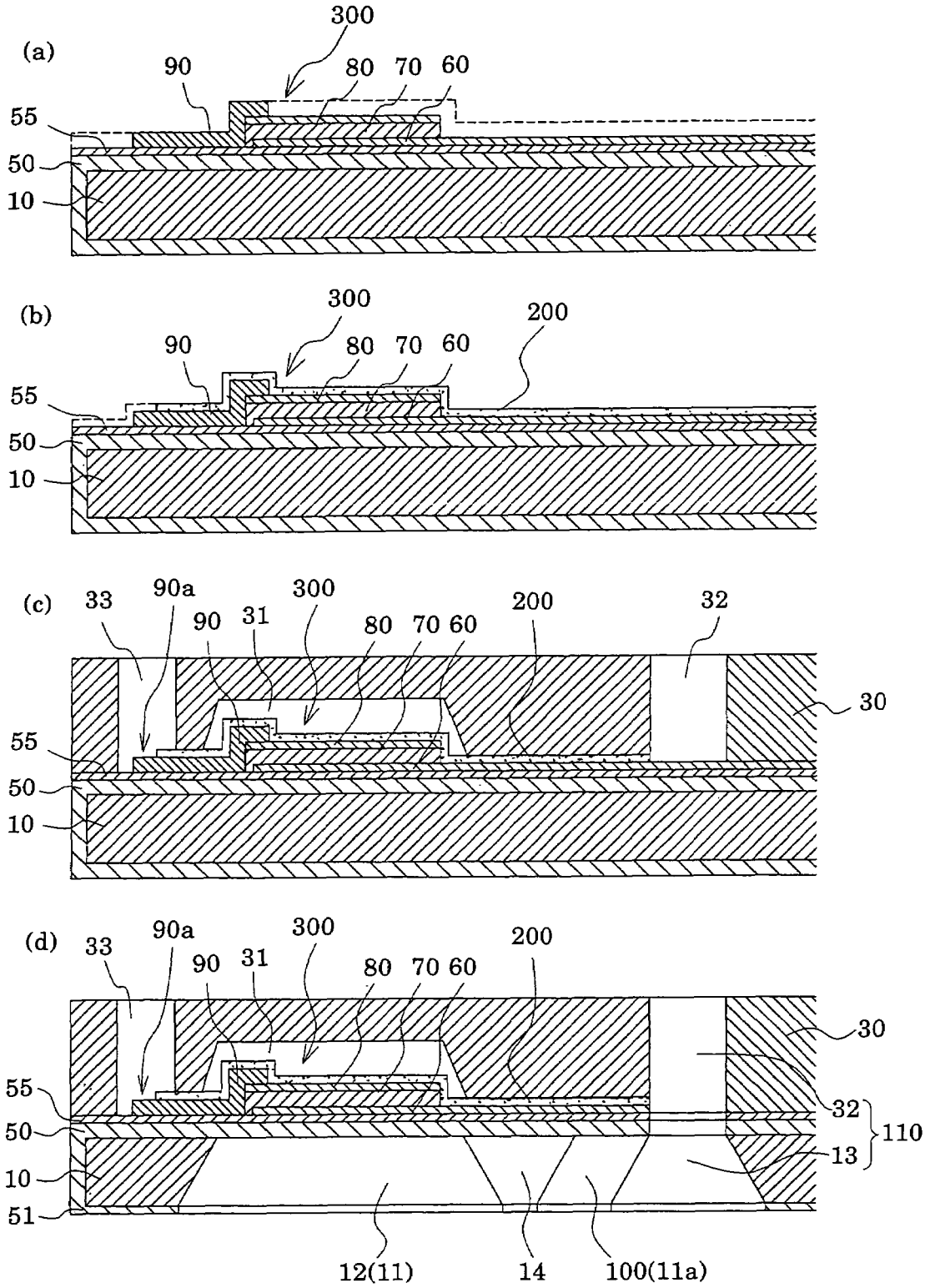
FIGS. 7(*a*) to 7(*d*) are cross-sectional views showing the steps of manufacturing the head according to embodiment 1.

Although the one example of the ink-jet recording head of the present invention has been described above, a manufacturing method thereof is not particularly limited. Note that, with reference to FIGS. 6 and 7, an example of a method of manufacturing the ink-jet recording head according to this embodiment will be described below. FIGS. 6 and 7 are cross-sectional views of the pressure generating chamber 12 in the longitudinal direction.

First, as shown in FIG. 6(*a*), a wafer of a single crystal silicon substrate to be the passage-forming substrate 10 is thermally-oxidized in a diffusion furnace heated to about 1100° C. Thus, the elastic film 50 is formed all over the wafer. Thereafter, as shown in FIG. 6(*b*), the insulating film 55 made of zirconium oxide or the like is formed on the elastic film 50. Next, as shown in FIG. 6(*c*), after the lower electrode film 60 made of platinum and iridium, for example, is formed on the entire surface of the insulating film 55, the lower electrode film 60 is patterned to have a predetermined shape. Subsequently, as shown in FIG. 6(*d*), the piezoelectric layer 70 made of, for example, lead-zirconate-titanate (PZT) and the upper electrode film 80 made of, for example, iridium are sequentially laminated and these layers are simultaneously patterned to form the piezoelectric element 300.

Next, as shown in FIG. 7(*a*), the lead electrode 90 made of, for example, gold (Au) or the like is formed all over the passage-forming substrate 10 and is patterned for each piezoelectric element 300. The steps described above are included in a film formation process. Next, as shown in FIG. 7(*b*), the insulating film 200 made of an inorganic insulating material, in this embodiment, aluminum oxide ($Al_2O_3$) is formed and patterned to have a predetermined shape. Specifically, the insulating film 200 is formed all over the passage-forming substrate 10 and, thereafter, the insulating film 200 in regions which face the connection portion 60*a* of the lower electrode film 60 and the connection portion 90*a* of the lead electrode 90 is removed. Note that, in this embodiment, together with the insulating film 200 in the regions which face the connection portions 60*a* and 90*a*, the insulating film 200 in a region other than the pattern region including the lead electrode 90 and the respective layers constituting the piezoelectric element 300 is also removed. Needless to say, only the insulating film 200 in the regions which face the connection portions 60*a* and 90*a* may be removed. In either case, the insulating film 200 may be formed so as to cover the pattern region including the lead electrode 90 and the respective layers constituting the piezoelectric element 300, except the connection portion 60*a* of the lower electrode film 60 and the connection portion 90*a* of the lead electrode 90. Moreover, although a method for removing the insulating film 200 is not particularly limited, it is preferable to use dry etching such as ion milling, for example. Thus, selective removal of the insulating film 200 can be performed well.

Next, as shown in FIG. 7(*c*), the reservoir forming plate 30, in which the piezoelectric element holding portion 31, the reservoir portion 32 and the like are previously formed, is joined with the passage-forming substrate 10 at the piezoelectric element 300 side with an adhesive interposed therebetween. Note that the reservoir forming plate 30 as described above also plays a role in protecting the respective piezoelectric elements 300 from an alkaline solution in formation of the pressure generating chambers 12 and the like by subjecting the passage-forming substrate 10 to an anisotropic etching process in a process to be described later.

Thereafter, the single crystal silicon substrate (the passage-forming substrate 10) is subjected to an anisotropic etching process by use of the alkaline solution described above. Thus, the pressure generating chamber 12, the communicating portion 13, the ink supply path 14 and the communicating path 100 are formed. To be more specific, as shown in FIG. 7(*d*), after a mask pattern 51 is formed on a surface opposite to a joint surface of the passage-forming substrate 10 and the reservoir forming plate 30, the passage-forming substrate 10 is subjected to an anisotropic etching process by use of the mask pattern 51. Thus, the pressure generating chamber 12, the communicating portion 13, the ink supply path 14 and the communicating path 100 are formed. Note that, in performing the anisotropic etching as described above, the etching is performed in a state where the surface of the reservoir forming plate 30 is sealed by use of a protective film or the like. Moreover, at this time, the reservoir 110 is formed by penetrating the elastic film 50 and the insulating film 55, which are positioned at a boundary between the reservoir portion 32 and the communicating portion 13. As described above, in this embodiment, the ink supply path 14 and the like can be provided by penetrating the passage-forming substrate 10 in its thickness direction. Thus, by patterning the mask pattern 51 with high precision, the ink supply path 14, the communicating path 100 and the like can be formed with high precision. Therefore, a stable ink ejecting property is obtained.

Next, the nozzle plate 20 having the nozzle orifices 21 drilled therein is joined with a surface of the passage-forming substrate 10, which is opposite the reservoir forming plate 30. Note that, thereafter, the compliance plate 40 is joined on the reservoir forming plate 30, a drive IC is mounted on the reservoir forming plate 30 and the connection portion 60*a* of the lower electrode film 60 and the connection portion 90*a* of the lead electrode 90 are connected to the drive IC by use of connection wiring formed of bonding wires. Accordingly, the piezoelectric element 300 and the drive IC are electrically connected to each other. After the drive IC is mounted on the reservoir forming plate 30 as described above, the respective members such as the passage-forming substrate 10 and the reservoir forming plate 30 are divided into pieces with a chip size. Thus, the ink-jet recording head of this embodiment as shown in FIG. 1 is manufactured.

Other Embodiments

Although the embodiment of the present invention has been described above, it is needless to say that the present invention is not limited to the embodiment described above. For example, in the embodiment described above, the ink supply path 14 is formed by narrowing the passage in the width direction. However, without being limited thereto, the ink supply path may be formed by narrowing the passage in the thickness direction of the passage-forming substrate. Note that, in this case, the ink supply path is formed, for example, by subjecting the passage-forming substrate to an anisotropic etching (half-etching) process in its thickness direction.

Moreover, in the embodiment described above, the piezoelectric elements 300 are formed inside the piezoelectric element holding portion 31 of the reservoir forming plate 30. However, without being limited thereto, the piezoelectric element holding portion 31 does not have to be provided. Also in this case, the surfaces of the piezoelectric elements 300 and the lead electrode 90 are covered with the insulating film 200 made of the inorganic insulating material. Thus, destruction of the piezoelectric layer 70 due to moisture (humidity) is surely prevented.

Furthermore, in the embodiment described above, the piezoelectric elements 300 are covered with the insulating film 200. However, without being limited thereto, the piezoelectric elements do not have to be covered with the insulating film.

Furthermore, in the embodiment described above, the air release hole 31*a* which has one end communicating with the piezoelectric element holding portion 31 and the other end released to the atmosphere is provided in the reservoir forming plate 30 and the piezoelectric element holding portion 31 is released to the atmosphere. However, without being limited thereto, the piezoelectric element holding portion may be sealed without providing the air release hole. In this case, destruction of the piezoelectric elements due to moisture (humidity) from the air release hole is surely prevented.

Moreover, in the embodiment described above, the thin-film ink-jet recording head manufactured by applying the deposition and lithography processes thereto was taken as an example. However, it is needless to say that the present invention is not limited thereto. For example, the present invention can also be adopted in a thick-film ink-jet recording head manufactured by use of a method of attaching a green sheet and the like.

Figure 8:
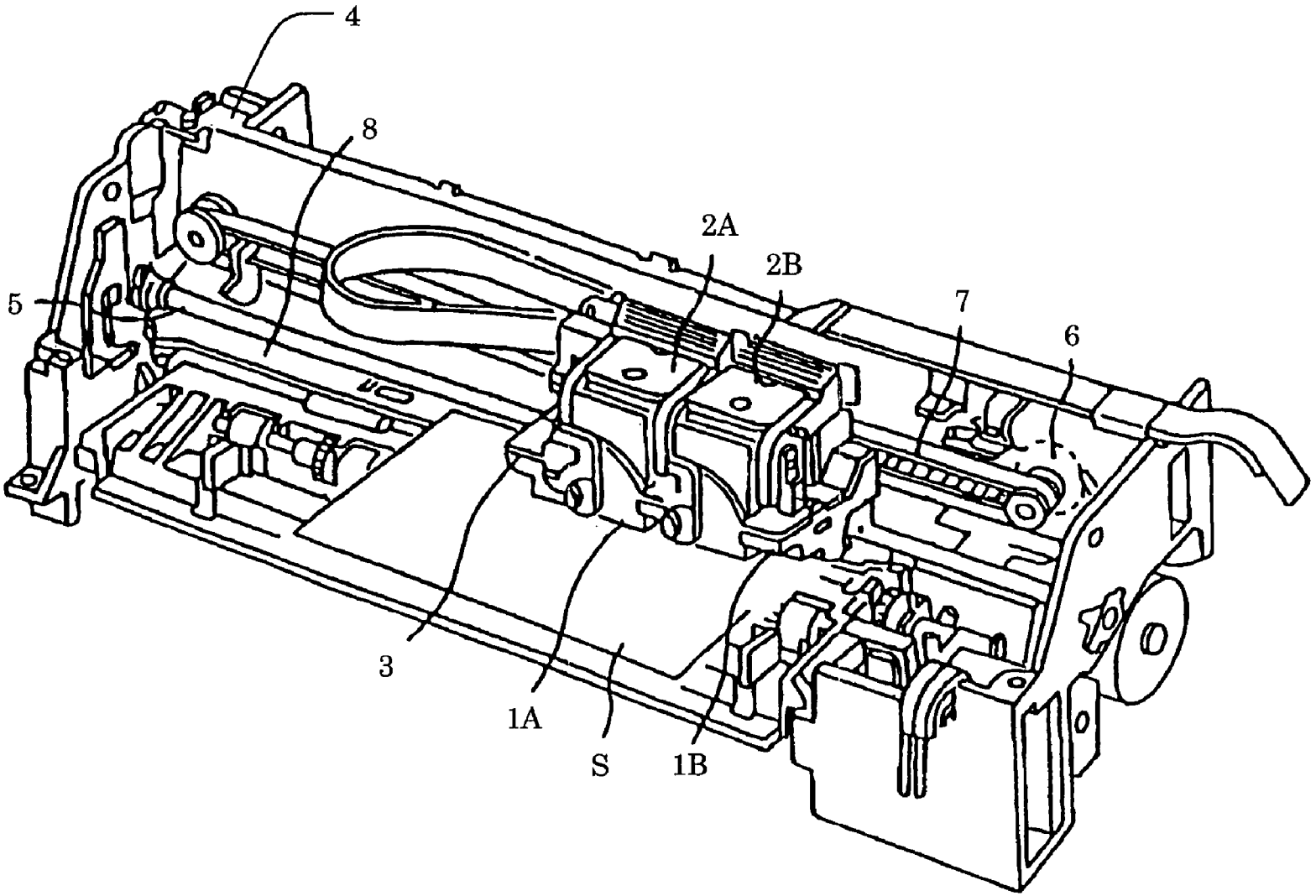
FIG. 8 is a schematic view showing an example of a recording head.

Furthermore, the ink-jet recording head of the respective embodiments described above constitutes a part of a recording head unit, which includes ink passages communicating with ink cartridges and the like, and is mounted on an ink-jet recording apparatus. FIG. 8 is a schematic view showing an example of the ink-jet recording apparatus. As shown in FIG. 8, in recording head units 1A and 1B having the ink-jet recording heads, cartridges 2A and 2B constituting ink supply means are provided so as to be detachable. A carriage 3 mounting the recording head units 1A and 1B thereon is provided on a carriage shaft 5 attached to an apparatus body 4 so as to be movable in an axial direction. These recording head units 1A and 1B, for example, eject a black ink composition and a color ink composition, respectively.

Accordingly, driving force of a drive motor 6 is transmitted to the carriage 3 through a plurality of gears (not shown) and a timing belt 7. Thus, the carriage 3 mounting the recording head units 1A and 1B thereon is moved along the carriage shaft 5. Meanwhile, a platen 8 is provided along the carriage shaft 5 in the apparatus body 4 and a recording sheet S which is a recording medium such as paper, and which is fed by an unillustrated paper feeding roller or the like, is conveyed on the platen 8.

Note that, in the embodiment described above, the ink-jet recording head which ejects ink as a liquid jet head and the ink-jet recording apparatus have been described as an example. However, the present invention is aimed widely at general liquid jet heads and liquid jet apparatuses. As the liquid jet head, for example, enumerated are: a recording head used in an image recording apparatus such as a printer; a color material jet head used for manufacturing color filters of a liquid crystal display and the like; an electrode material jet head used for forming electrodes of an organic EL display, a field emission display (FED) and the like; a bioorganic matter jet head used for manufacturing biochips; and the like.

The invention claimed is:

1. A liquid jet head comprising:

a passage-forming substrate in which a plurality of pressure generating chambers communicating with nozzle orifices are arranged;

piezoelectric elements which are provided on the passage-forming substrate with a vibration plate interposed therebetween and each of which includes a lower electrode, a piezoelectric layer and an upper electrode; and a reservoir forming plate which is joined with a surface of the passage-forming substrate at the piezoelectric element side and has a reservoir portion provided therein, the reservoir portion constituting a part of a reservoir that is a common liquid chamber of the respective pressure generating chambers, wherein the reservoir is formed of the reservoir port ion and a communicating portion provided in the passage-forming substrate, partitions at both sides in a width direction of the pressure generating chambers are provided to extend to the vicinity of an end of the reservoir portion at the pressure generating chamber side and thus liquid supply paths, each of which communicates with each of the pressure generating chambers and has a width smaller than that of the pressure generating chamber, and communicating paths, each of which allows the liquid supply path and the communicating portion to communicate with each other and has a width larger than that of the liquid supply path, are provided while being separated for each of the pressure generating chambers by the partitions, and wherein a distance between an end of each of the partitions at the reservoir portion side and the reservoir portion is shorter than the thickness of the passage-forming substrate.

2. The liquid jet head according to claim 1, wherein a relationship between the width $w_1$ of the communicating path and the width $w_2$ of the pressure generating chamber satisfies $w_1 \geqq w_2$.

3. The liquid jet head according to claim 2, wherein a relationship between the width $w_1$ of the communicating path and the width $w_3$ of the liquid supply path satisfies $w_1 \geqq 2 \times w_3$.

4. A liquid jet apparatus comprising:

the liquid jet head according to claim 3.

5. A liquid jet apparatus comprising:

the liquid jet head according to claim 2.

6. The liquid jet head according to claim 1, wherein a relationship between the width $w_1$ of the communicating path and the width $w_3$ of the liquid supply path satisfies $w_1 \geqq 2 \times w_3$.

7. A liquid jet apparatus comprising:

the liquid jet head according to claim 6.

8. The liquid jet head according to claim 1, wherein a length of the communicating path is equal to or longer than a thickness of the passage-forming substrate.

9. A liquid jet apparatus comprising:

the liquid jet head according to claim 8.

10. The liquid jet head according to claim 1, wherein the piezoelectric elements are covered with an insulating film made of an inorganic insulating material.

11. The liquid jet head according to claim 10, wherein the insulating film is made of $Al_2O_3$.

12. A liquid jet apparatus comprising:

the liquid jet head according to claim 11.

13. A liquid jet apparatus comprising:

the liquid jet head according to claim 10.

14. The liquid jet head according to claim 1, wherein, in the reservoir forming plate, a piezoelectric element holding portion capable of securing a space without inhibiting movement of the piezoelectric elements is provided in a region which faces the piezoelectric elements, and a region between the piezoelectric element holding portion and the reservoir portion in the reservoir forming plate is a junction portion between the reservoir forming plate and the passage-forming substrate.

15. The liquid jet head according to claim 14, wherein ends of the partitions at the reservoir portion side are positioned in a region which faces the junction portion.

16. A liquid jet apparatus comprising:

the liquid jet head according to claim 15.

17. The liquid jet head according to claim 14, wherein a length of the junction portion is equal to or longer than 200 μm.

18. A liquid jet apparatus comprising:

the liquid jet head according to claim 17.

19. The liquid jet head according to claim 14, further comprising:

an air release hole which has one end communicating with the piezoelectric element holding portion and the other end released to the atmosphere.

20. A liquid jet apparatus comprising:

the liquid jet head according to claim 19.

21. A liquid jet apparatus comprising:

the liquid jet head according to claim 14.

22. The liquid jet head according to claim 1, wherein the thickness of the passage-forming substrate is equal to or shorter than 100 μm.

23. A liquid jet apparatus comprising:

the liquid jet head according to claim 22.

24. The liquid jet head according to claim 1, wherein the pressure generating chambers are formed by subjecting a single crystal silicon substrate to an anisotropic etching process.

25. A liquid jet apparatus comprising:

the liquid jet head according to claim 24.

26. A liquid jet apparatus comprising:

the liquid jet head according to claim 1.

27. A liquid jet apparatus comprising:

the liquid jet head according to claim 26.

* * * * *